United States Patent [19]

Haytayan

[11] Patent Number: 4,560,061

[45] Date of Patent: Dec. 24, 1985

[54] POWDER CHARGE FEED STRIP

[75] Inventor: Harry M. Haytayan, Lincoln, Mass.

[73] Assignee: Pneutek, Inc., Hudson, N.H.

[21] Appl. No.: 531,654

[22] Filed: Sep. 13, 1983

[51] Int. Cl.[4] ..... F42B 37/00

[52] U.S. Cl. ..... 206/3; 206/347; 206/346

[58] Field of Search ..... 206/347, 346, 3

[56] References Cited

U.S. PATENT DOCUMENTS

| | | | |
|---|---|---|---|
| 2,784,405 | 3/1957 | Working, Jr. | 206/347 |
| 3,211,284 | 10/1965 | Anstett | 206/347 |
| 3,904,032 | 9/1975 | Maier | 206/347 |
| 3,954,176 | 5/1976 | Haytayan | 206/347 |
| 3,955,674 | 5/1976 | Maier et al. | 206/347 |
| 4,019,631 | 4/1977 | Lejdegard et al. | 206/347 |

*Primary Examiner*—Joseph Man-Fu Moy

*Attorney, Agent, or Firm*—Schiller & Pandiscio

[57] ABSTRACT

An improved cartridge-holding magazine is provided for powder-actuated fastener driving tools. The magazine is in the form of a flat strip having a series of cartridge-receiving holes and grooves surrounding the holes for receiving an end extension of a chamber-defining portion of a fastener driving tool so as to properly locate the cartridges in the chamber. The grooves define sleeve portions in the strip which cooperate with the surrounding surface of the side wall of the cartridge chamber to prevent the side wall of a cartridge casing from rupturing or fracturing, especially near the rim of the cartridge, when the cartridge is fired, with the result that after ignition the gases expand axially into the chamber to propel the fastener driving striker so as to drive a fastener into a workpiece with maximum utilization of the energy of combustion.

12 Claims, 9 Drawing Figures

POWDER CHARGE FEED STRIP

FIELD OF THE INVENTION

This invention relates to the feeding of powder charges to semiautomatic, powder-actuated nail driving tools, and more particularly to a new and improved powder charge feed strip or magazine.

BACKGROUND OF THE INVENTION

Semiautomatic, powder-actuated fastener-driving tools are well known, as exemplified by U.S. Pat. Nos. 3,168,744, 3,499,590, 3,552,625, 3,554,425, 3,565,313 and 3,743,159. Powder cartridge feed strips or magazines also are well known in the art, as exemplified by U.S. Pat. No. 3,611,870.

Such tools typically comprise a housing, a barrel mounted in telescoping relation to the housing and adapted to receive at its forward end a fastener which is to be driven by the tool, a chamber for receiving a cartridge, a duct or passageway extending approximately perpendicularly to the main axis of the tool for receiving a cartridge feed strip, strip feeding means for advancing a cartridge feed strip so as to successively position successive cartridges carried by the feed strip in position to enter said chamber, striker means in position to be propelled forward by the hot gases of combustion so as to drive a fastener out of the barrel into a workpiece, and means for firing a cartridge positioned in said chamber so as to cause the striker means to drive a fastener located in the muzzle end of the barrel into a workpiece.

One well known semi-automatic, powder-actuated tool for driving fasteners, hereinafter referred to as the "moving cylinder" tool, consists of a housing having a handle, a cylinder member slidably mounted within the housing having a chamber at its rear end for receiving a cartridge, a barrel member mounted in telescoping relation with the cylinder and housing, the front end or muzzle of said barrel member being adapted to receive a fastener which is to be driven into a workpiece, a fastener-driving striker member slidably disposed in the cylinder and barrel and adapted to be propelled forward by the hot gases produced by the firing of a cartridge in the chamber, a passageway or duct extending along the handle for receiving a cartridge feed strip, strip feeding means for advancing the feed strip one cartridge at a time through the passageway so as to successively locate successive cartridges in position to mate with the firing chamber in the cylinder member, and trigger-operated means for firing a cartridge located in said chamber. After a cartridge has been fired to drive a fastener into a workpiece, the operator causes the cylinder member to be fully extended and then retracted. This action causes the cartridge feedstrip to be advanced so as to move the spent cartridge out of alignment with the chamber and locate the next loaded cartridge in position to mate with the chamber. The rear firing chamber end of the cylinder member has an extension which is in the form of a cylindrical sleeve slotted at three or four circumferentially spaced places so as to provide finger-like sections.

The "moving cylinder" form of powder-actuated tool typically uses a cartridge magazine which consists of a plastic strip with flat oppositely directed face surfaces and holes in which the cartridges are press-fitted. Each side edge of the strip has a plurality of notches for engagement by part of the strip advancing mechanism.

The rims of the cartridges protrude from one face surface of the strip. Each cartridge is sized to fit within the cylindrical extension at the rear end of the cylinder member. The finger-like sections of the cylinder member are sized to fit in openings in the feed strip around the chambered cartridge in line with the cartridge rim and serve to partially envelop the casing and engage the rim of the chambered cartridge. When the tool is fired by means of its trigger-operated hammer impacting a cartridge positioned in the chamber, the exploding charge generates gases which drive the striker member forward so as to cause a nail or other fastener positioned in the front end of the barrel member to be driven into a workpiece which is engaged by the barrel member. This form of tool cannot be fired unless the barrel is pressed against a workpiece.

An improved form of "moving cylinder" powder-actuated tool is described in my pending U.S. patent application Ser. No. 497,701, filed May 24, 1983.

As is well known to persons skilled in the art, there are various types of powder cartridges. One of the more common types in the U.S.A. is the 0.22 caliber, star crimped, necked-down cartridge. That particular cartridge and other types of cartridges are available with different loads, i.e., with different powder charges. The charge with the greatest amount of powder is the so-called "red charge" (also known in the industry as the "Power Level 5" cartridge). The next smaller size charge is the so-called "yellow charge". An objective in the industry is to be able to safely use red charge cartridges in a so-called "low velocity tool". Unfortunately cartridges made by various manufacturers frequently exceed the loading tolerences by as much as 20%. Accordingly, in the case of "red charges" used in a low velocity "moving cylinder" tool, if a charge exceeds specifications by 20%, the cartridge may fire in an explosion mode which causes the side wall of the cartridge casing to fracture close to its rim between the finger-like sections of the rear extension of the cylinder member. This mode of explosion is dangerous, may lead to injury to the operator, and also reduces the effectiveness of the charge since some of the combustion gases tend to be lost in a high velocity lateral discharge through the slots in the cylindrical extension on the end of the cylinder member rather than being directed forward so as to drive the fastener which is positioned in the front end of the barrel member. If one cartridge in a magazine is found to have an explosive charge, the whole magazine becomes suspect and may be discarded by the operator to avoid another possibly dangerous situation.

Another problem with the charge magazines of the kind heretofore used in the "moving cylinder" type of power-actuated tools is that a substantial thickness of strip material is disposed between the rim of the cartridge and the extension on the rear end of the cylinder with which the strip is engaged when the tool is fired. Because of this thickness and also because the plastic strip tends to be somewhat compressible, the hammer is required to strike the rim of the cartridge with a substantial force in order to make certain that the cartridge will fire under the impact of the hammer. The required driving force is reduced if the strip is made of a relatively rigid material. However, a somewhat compressible material is required in order to better allow the cartridges to be attached to the strip by a simple press fit. Furthermore, for reasons of economy, it is preferred to make the cartridge strips of relatively low cost materials such as polyethylene which can be injection molded. Unfortunately, such materials tend to deform easily.

SUMMARY OF THE INVENTION

It has been determined that the problem in "moving cylinder" tools of side fracture of "red charge" cartridges where the charge level exceeds the allowed tolerance may be overcome or substantially reduced by providing an improved cartridge feed strip which is arranged so that the casing of each cartridge located in firing position is supported adjacent its rim by a portion of the strip and also by the extension of the cylinder member at the moment at which the cartridge is exploded.

Accordingly, a primary object of this invention is to provide a cartridge magazine or feed strip which is arranged so as to follow the casing of each cartridge located in the firing chamber to be entirely surrounded adjacent its rim by a portion of the feed strip and also by a portion of the cylinder member, whereby the cartridge casing is prevented from undergoing a side fracture when it is fired and substantially all of the combustion gases are directed into the cylinder member.

A second important object of the invention is to provide a cartridge holding strip which is symmetrical and which may be inserted into the tool either end first.

Another important object of the invention is to provide a cartridge feed strip or magazine which holds a plurality of cartridges and which has means for cooperating with the end of the cylinder so as to properly locate each charge in the chamber at the rear end of the cylinder, while at the same time eliminating the possibility of the cartridge casing being fractured adjacent its rim so as to allow the escape of combustion gases in a lateral direction close to the rim.

BRIEF DESCRIPTION OF THE DRAWINGS

These and other objects and features of the present invention are disclosed or rendered obvious by the following detailed description of the preferred embodiment of the invention, which is to be considered together with the accompanying drawings wherein.

In the several views, like numerals refer to like parts.

DETAILED DESCRIPTION OF THE PREFERRED EMBODIMENT

Figure 1:
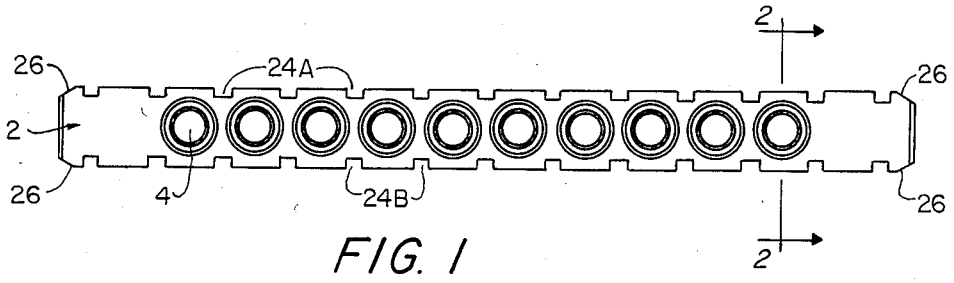
FIG. 1 is a plan view of a cartridge feed strip embodying the present invention.

The present invention has particular application for use with powder-actuated or explosion-driven tools or guns for driving fasteners into a hard material such as concrete or steel.

The present invention is intended for use with, but is not restricted to, a tool of the type disclosed in my pending U.S. patent application Ser. No. 497,701. For reasons of brevity, the tool shown in my copending application is not reproduced in the drawings. However, reference is had to the cylinder member of that tool in order to describe how such member could be modified to utilize the present invention, and to that extent, the disclosure of my copending application is incorporated herein by reference.

Figure 2:
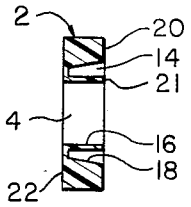
FIG. 2 is a sectional view taken along line 2—2 of FIG. 1.
Figure 3:
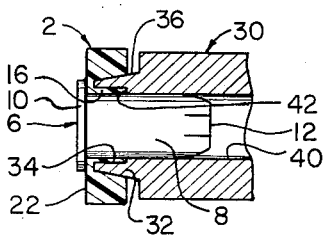
FIG. 3 is a sectional view showing the cartridge strip of FIG. 1 in relation to the rear end of the cylinder member of a powder-actuated tool, with one of the cartridges positioned in the cylinder member.

Turning first to FIGS. 1–3, there is shown a cartridge feed strip or magazine which comprises a plastic strip 2 having a plurality of like holes 4 for receiving the casing of a powder-containing cartridge 6. With reference to FIG. 3, each cartridge consists of a casing 8 and a rim 10. The front end of casing 8 is crimped as shown at 12 so as to close off and contain a powder charge (not shown).

The strip 2 has a plurality of tapered circular grooves 14 which concentrically surround each of the holes 4. As a result of the grooves 14, a sleeve portion 16 is formed at each hole 4. Each sleeve portion 16 is of cylindrical construction and has constant diameter inner and outer surfaces. The inner diameter of each sleeve portion 16 is the same as that of holes 4. Each groove 14 also is formed so as to define tapered circular walls 18 concentric with sleeves 16. Each cylindrical sleeve portion 16 terminates substantially in the same plane as the front surface 20 of the strip. Both the front surface 20 and the rear surface 22 of the strip are flat. The terms "front" and "back" are used herein merely for convenience of description and not in a limiting sense. Additionally, each strip has a plurality of equally spaced notches 24A and 24B on opposite sides thereof. Notches 24A are exactly aligned with notches 24B. Each notch is located at a point midway between two adjacent holes 4. Each end of the strip also is beveled so as to form a pair of inclined surfaces 26 to facilitate insertion of the strip into the powder-actuated tool.

The strip 2 may be made of any suitable material. Preferably it is made of a synthetic plastics material which is somewhat resilient. A preferred plastics material is polyethylene. However, other suitable plastics materials which may be used are polypropylene and polyvinylchloride. Still other suitable plastics material will be obvious to persons skilled in the art.

Referring to FIG. 3, each cartridge is inserted into the strip 2 so that the underside of the cartridge's rim 10 engages rear surface 22 of the strip and the portion of casing 8 adjacent rim 10 is surrounded and gripped by the sleeve 16. The holes 4 are sized so that the cartridges 6 will make a tight fit within the strip, i.e., so that the sleeves 16 will tightly surround the casings 8 of the cartridges adjacent their rims 10. Preferably holes 4 are formed with a diameter about 0.003 in. less than the ouside diameter of casing 8.

FIG. 3 shows a cartridge strip 2 with one of its cartridges 6 disposed within the rear end of a steel cylinder member 30 of a tool of the "moving cylinder" type. Cylinder member 30 is substantially the same as the cylinder member described in my pending U.S. patent application Ser. No. 499,701, except that the rear end of the cylinder member has no finger-like sections. Instead, the rear end of cylinder member 30 is formed with a cylindrical extension or collar 32 which is characterized by a counterbore defining a cylindrical inner surface 34. The outer surface 36 of extension 32 is conically shaped or tapered. Cylinder member 30 has a center bore 40 with a diameter somewhat less than the inner surface 34 of extension 32, thereby forming a shoulder 42. The end of bore 40 and extension 32 form a chamber for receiving a loaded cartridge 6. The diameter of inner surface 34 is made only slightly larger (e.g., a few thousandths of an inch) than the diameter of the outer surface of sleeve portions 16 so as to allow each sleeve portion 16 to nest snugly in the counterbore. The axial distance from the end of the extension 32 to the shoulder 42 is selected so as to allow the forward end surface 21 (FIG. 2) of a sleeve 16 to abut or be adjacent to shoulder 42 (FIG. 3). The taper of surface 36 is at the same angle as the taper of the surface 18, so as to assure that surface 18 will lie against and contact surface 36 when a cartridge 6 is disposed within bore 40.

As a result of the foregoing strip and cylinder construction, each time a tool of the type described in my pending U.S. patent application Ser. No. 499,701, loaded with a cartridge strip made in accordance with the present invention, is operated so as to cause a cartridge to be fired to drive a fastener into a workpiece, the gases formed by the ignited cartridge will be confined within cylinder 30. Because the casing 8 of the fired cartridge is reinforced by a sleeve portion 16 which in turn is reinforced by extension 32 of the cylinder member, the sidewall of the casing of the fired cartridge 6 will tend to remain intact and the rim-fired explosion of the charge in the cartridge 6 will cause the forward crimped end of the cartridge to open and combustion gases to flow out of the cartridge via that open end so as to cause rapid forward movement of the striker member. When the tool is reloaded, by movement of the cylinder member and barrel, cartridge strip 2 is advanced by the tool's cartridge strip feeding mechanism in cooperation with the notches 24A or 24B a distance equal to the distance between two adjacent cartridges in the strip, i.e., the center-to-center distance of holes 4, whereby a new cartridge 6 is located in axial alignment with the bore 40 of cylinder member 30. As cylinder member 30 is returned rearwardly to its "ready" position, the front end of the cartridge which is aligned with bore 40 will be chambered in that bore and the sleeve 16 which surrounds that cartridge will enter the counterbore formed by the inner surface of extension 36 but will be spaced from shoulder 42. When the muzzle of the barrel is pressed against a workpiece in preparation for firing the tool, the cylinder member 30 will be forced rearwardly in the housing far enough to cause the strip to be seated tightly on extension 32 in the manner shown in FIG. 3. Accordingly, when thereafter the tool is fired, the fired cartridge will tend to direct its gases of combustion forward into bore 40 of cylinder member 30 and no fracture of the casing 8 will occur adjacent to the rim 10 because of the casing reinforcement provided by sleeve portion 16 of the strip and extension 32. Consequently, the operator is in no danger of being injured by the explosion and virtually all of the exploding gases of combustion are directed forward in the cylinder to drive a fastener into a workpiece.

MODIFICATIONS OF THE PREFERRED EMBODIMENT

It is to be noted that the preferred embodiment described above may be modified without departing from the scope of the present invention.

Figure 4:
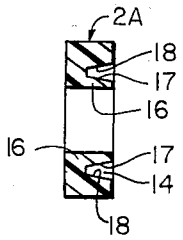
FIG. 4 is a sectional view showing a modified form of cartridge feed strip.
Figure 6:
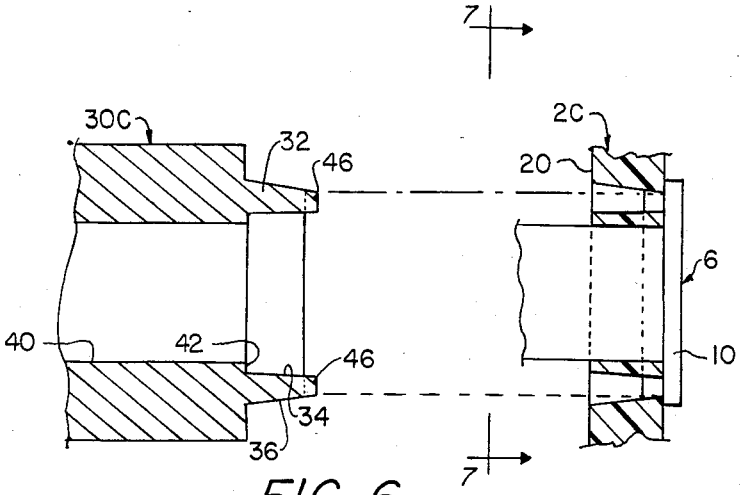
FIG. 6 is a sectional view showing another modified form of cartridge feed strip, with the strip and a cartridge being shown in exploded relation to the rear end of a cylinder member of a powder-actuated tool.
Figure 7:
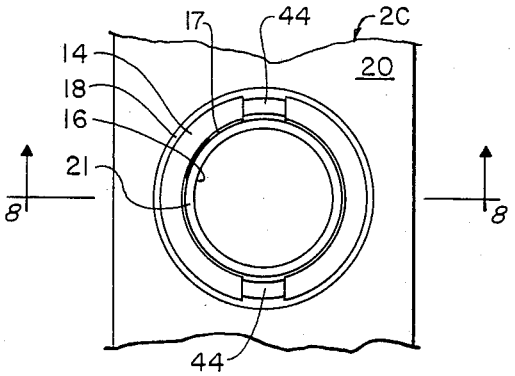
FIG. 7 is a plan view of the cartridge feed strip of FIG. 6, taken from the view plane of line 7—7 of FIG. 6.
Figure 8:
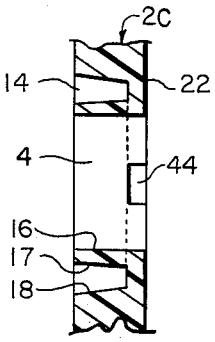
FIG. 8 is a sectional view taken along line 8—8 of FIG. 7.
Figure 9:
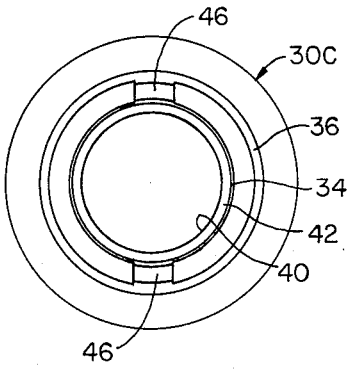
FIG. 9 is an end view of the cylinder member of FIG. 6.

Thus, for example, as shown in FIG. 4, cartridge strip 2A may be formed with its groove 14 made so that the outer surface 17 of sleeve section 16 is tapered, rather than being cylindrical as shown previously. Of course, in this context it is to be appreciated that if the cartridge strip's groove 14 is formed with the tapered surface 17, cylinder member 30 will have its surface 34 correspondingly tapered in order to allow surfaces 17 and 34 to mate with one another properly. It is also to be appreciated that the angle of taper of the mating surfaces 18 and 36, or of 17 and 34, may be varied from that shown.

Figure 5:
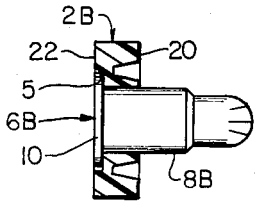
FIG. 5 is a sectional view showing another modified form of cartridge feed strip.

Referring now to FIG. 5, it also is contemplated that cartridge strip 2B may be formed with counterbores 5 at one side of holes 4 for the purpose of receiving the rims 10 of the cartridges, whereby the cartridge may be mounted so that their rims are flush with or recessed relative to the surface 22 of the strip. In addition, it is envisioned that one or more of the cartridges carried by strip 2 may be of the type shown in FIG. 5, i.e., a cartridge 6B having a necked-down casing 8B.

Yet another contemplated modification is illustrated in FIGS. 6–9. Cartridge strip 2C (FIGS. 6–8) is formed with a plurality of openings 44, each of which intersects and extends between the base of a groove 14 and rear surface 22 of the strip. At the same time, cylinder member 30C (FIGS. 6 and 9) is formed with one or more fingers 46 extending outward from its cylindrical extension 32. The size, number and location of the cylinder member's fingers 46 are coordinated with the size, number and location of the openings 44 associated with each hole 4, in order that when a cylinder member 30C is brought into engagement with strip 2C so as to chamber a cartridge 6 carried by the strip, fingers 46 will extend through openings 44 and directly engage the forward-facing undersurface of the cartridge's rim 10. As a result, the chambered cartridge 6 is firmly supported by the cylinder member, and when subsequently rim 10 is struck by the tool's firing pin to fire the cartridge, the firing of the cartridge will occur with minimum buckling or deformation of the cartridge strip and no lateral fracture of the cartridge casing.

It is to be appreciated that the strip may be made of a material other than the materials listed above. Furthermore, sleeves portions 16 need not terminate flush with the surface 20 of strip 2; instead, sleeve portions 16 may be foreshortened so that their forward surfaces 21 are recessed behind front surface 20 of the strip, or lengthened so that they project beyond front surface 20. The holes 4 also may have a different diameter than the internal diameter of sleeve portions 16, e.g., the i.d. of sleeve portions 16 may be less than the diameter of holes 4.

Still other changes and modifications will be obvious to persons skilled in the art.

What is claimed is:

1. A powder charge feed strip for introducing explosive powder cartridges into an explosive powder-actuated fastener-driving tool, comprising:

an elongated body made of a thermoplastic material having first and second oppositely facing flat face surfaces and first and second oppositely facing side edge surface extending between said face surfaces;

a plurality of circular holes in said elongated body extending through said first and second face surfaces, said holes being aligned lengthwise of said elongated body; and a plurality of annular grooves in said first face surface concentrically surrounding and spaced from said holes and coacting with said holes so as to define sleeve portions in said elongated body which act as cartridge-receiving chambers, said grooves being shaped in cross-section so that said elongated body has tapered circularly extending surfaces in spaced and surrounding relationship with said sleeve portions; and explosive powder cartridges disposed in said holes with the rims of said cartridges engaged with said elongated body on the side opposite said first face surface, said holes having a diameter slightly less than the outside diameter of the casings of said cartridges adjacent said rims, so that said sleeve portions tightly surround and grip the casings of said cartridges adjacent said rims.

2. A strip according to claim 1 wherein said each of said holes has an enlarged counterbore on the second face surface side of said elongated body, and said rims are disposed in said counterbores flush with said second face surface.

3. A strip according to claim 1 wherein said sleeve portions have end surfaces which are substantially flush with said first face surface.

4. A strip according to claim 1 having a plurality of notches in at least one side edge surface of said body.

5. A strip according to claim 1 further including at least one opening extending between the base of each groove and said second face surface.

6. A strip according to claim 4 wherein said grooves are tapered so as to be widest at said first face surface, and further including a plurality of notches in each of said first and second side edge surfaces to facilitate feeding of said strip into a powder actuated fastener-driving tool.

7. A strip according to claim 1 further including at least two openings in said elongated body adjacent each of said holes, each of said openings intersecting said second face surface and one of said grooves.

8. A strip according to claim 7 having only two of said openings adjacent each of said holes.

9. A strip according to claim 8 wherein said two openings are displaced 180 degrees from one another along a diameter of said each hole.

10. A strip according to claim 4 having notches in said first and second side edge surfaces with the notches in said first side edge surface being with the notches in said second side edge surface, and the spacing between said holes is identical to the spacing between said notches.

11. A strip according to claim 10 wherein the notches in said first and second side edge surfaces are aligned with one another between said holes.

12. A cartridge strip according to claim 10 further including a plurality of explosive powder cartridges disposed in said holes so that the rims of said cartridges are on the second face surface side of said elongated body, each of said cartridges comprising a cylindrical casing and a rim at one end of the casing, said holes being formed with a diameter slightly less than the outside diameter of the casings of said cartridges adjacent said rims, whereby said tubular sleeves tightly surround the casings of said cartridges adjacent said rims.

* * * * *

UNITED STATES PATENT AND TRADEMARK OFFICE

CERTIFICATE OF CORRECTION

PATENT NO. : 4,560,061

DATED : December 24, 1985

INVENTOR(S) : Harry M. Haytayan

It is certified that error appears in the above-identified patent and that said Letters Patent is hereby corrected as shown below:

Claim 1, line 7, change "surface" to -- "surfaces" --.

Claim 6, line 1, change Claim 4 to Claim 1.

Claim 10, line 3, after "being" insert -- "aligned" --.

Signed and Sealed this

Twenty-third Day of December, 1986

*Attest:*

DONALD J. QUIGG

*Attesting Officer* *Commissioner of Patents and Trademarks*